US009896942B2

(12) United States Patent
Shepherd

(10) Patent No.: US 9,896,942 B2
(45) Date of Patent: Feb. 20, 2018

(54) COOLED TURBINE GUIDE VANE OR BLADE FOR A TURBOMACHINE

(71) Applicant: Siemens Aktiengesellschaft, Munich (DE)

(72) Inventor: Andrew Shepherd, Branston (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 468 days.

(21) Appl. No.: 14/352,106

(22) PCT Filed: Oct. 2, 2012

(86) PCT No.: PCT/EP2012/069396
§ 371 (c)(1),
(2) Date: Apr. 16, 2014

(87) PCT Pub. No.: WO2013/056975
PCT Pub. Date: Apr. 25, 2013

(65) Prior Publication Data

US 2015/0016961 A1 Jan. 15, 2015

(30) Foreign Application Priority Data

Oct. 20, 2011 (EP) ..... 11185955

(51) Int. Cl.
*F01D 5/18* (2006.01)
*F01D 9/06* (2006.01)

(52) U.S. Cl.
CPC ..... *F01D 5/187* (2013.01); *F01D 5/186* (2013.01); *F01D 9/065* (2013.01); *F05D 2260/203* (2013.01)

(58) Field of Classification Search
CPC ..... F01D 5/186; F01D 5/187; F01D 9/065; F05D 2260/203
(Continued)

(56) References Cited

U.S. PATENT DOCUMENTS 3,628,880 A 12/1971 Smuland et al.
4,021,139 A 5/1977 Franklin
(Continued)

FOREIGN PATENT DOCUMENTS

EP 1035302 9/2000
EP 1050663 11/2000
(Continued)

*Primary Examiner* — Mark Laurenzi
*Assistant Examiner* — Paul Thiede
(74) *Attorney, Agent, or Firm* — Beusse Wolter Sanks & Maire

(57) ABSTRACT

A turbine airfoil has a suction side wall and a pressure side wall of an airfoil cavity, through which a cooling fluid flows for cooling of the side walls. The suction side wall has one or more protrusions extending therefrom into the airfoil cavity. The protrusions are arranged such that: a number of the one or more protrusions on the suction side wall is higher than a number of protrusions on the pressure side wall; and/or a protrusion density on the suction side wall is higher than a protrusion density on the pressure side wall, and/or a total protrusion surface area on the suction side wall is larger than a total protrusion surface area on the pressure side wall, so that the heat transfer from the suction side wall to the cooling fluid is higher compared to that of the pressure side wall during operation of the turbomachine.

15 Claims, 1 Drawing Sheet

(58) Field of Classification Search
USPC ..... 415/115; 416/97 R
See application file for complete search history.

(56) References Cited

U.S. PATENT DOCUMENTS

| | | | | |
|---|---|---|---|---|
| 4,086,021 | A | 4/1978 | Stenfors | |
| 4,515,523 | A | 5/1985 | North et al. | |
| 5,361,828 | A * | 11/1994 | Lee | F01D 5/187 165/109.1 |
| 5,468,125 | A | 11/1995 | Okpara et al. | |
| 5,700,132 | A | 12/1997 | Lampes et al. | |
| 5,738,493 | A | 4/1998 | Lee et al. | |
| 5,752,801 | A | 5/1998 | Kennedy | |
| 6,290,462 | B1 | 9/2001 | Ishiguro et al. | |
| 8,043,058 | B1 * | 10/2011 | Liang | F01D 5/187 415/173.1 |
| 2003/0086785 | A1 | 5/2003 | Bunker et al. | |
| 2010/0143153 | A1 * | 6/2010 | Gross | F01D 5/187 416/97 R |
| 2010/0221121 | A1 | 9/2010 | Liang | |
| 2011/0311369 | A1 * | 12/2011 | Ramachandran | F01D 5/186 416/97 R |

FOREIGN PATENT DOCUMENTS

| | | |
|---|---|---|
| EP | 1113145 | 7/2001 |
| EP | 1321712 | 6/2003 |
| EP | 1327747 | 7/2003 |
| EP | 1707741 | 10/2006 |
| EP | 1775420 | 4/2007 |
| EP | 2233693 | 9/2010 |
| FR | 2725474 | 4/1996 |
| JP | 61187501 | 8/1986 |

* cited by examiner

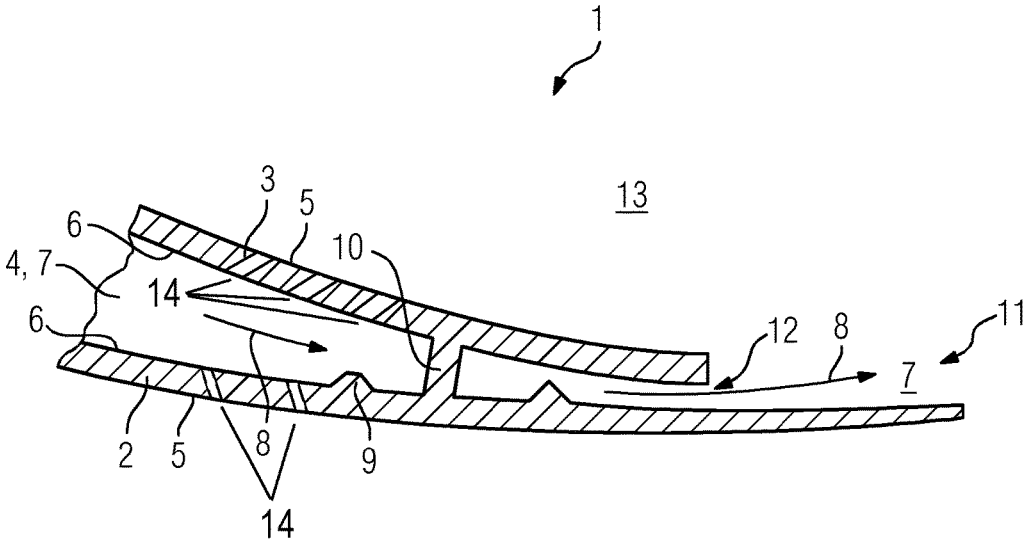
1
13
3
5
6
10
4, 7
14
6
12
8
11
7
2
5
8
9
14

COOLED TURBINE GUIDE VANE OR BLADE FOR A TURBOMACHINE

CROSS REFERENCE TO RELATED APPLICATIONS

This application is the US National Stage of International Application No. PCT/EP2012/069396 filed Oct. 2, 2012, and claims the benefit thereof. The International Application claims the benefit of European Application No. EP 11185955 filed Oct. 20, 2011. All of the applications are incorporated by reference herein in their entirety.

FIELD OF INVENTION

The invention relates to a cooled blading of a turbine.

BACKGROUND OF INVENTION

A turbomachine, in particular a gas turbine, comprises a turbine in which a hot gas is expanded for attaining a mechanical work, after the hot gas had been compressed in a compressor and heated up in a combustion chamber. For a high mass flow rate and therefore for a high power of the gas turbine the latter is designed as an axial gas turbine, wherein the turbine comprises a plurality of consecutive blade rings. The blade rings comprise alternately guide vanes attached to the housing of the gas turbine and rotor blades attached to a rotor of the gas turbine. Guide vanes and/or rotor blades can be referred to as blading. A single vane or guide vane or a single blade or rotor blade is also called airfoil as a more general term.

The higher the inlet temperature of the hot gas is in the turbine the higher is the thermodynamic efficiency of the gas turbine. The maximal acceptable inlet temperature is limited because of the limited thermal resilience of the turbine blading. It is desirable to design a turbine blading which can cope with a high thermal load but it must have a sufficient mechanical stability. Conventional turbine bladings comprise materials or combinations of materials which allow only part of the potential for raising the thermal efficiency of the gas turbine. For a further rise of the inlet temperature it is known to cool the turbine blading, so that it is subjected to a lower thermal load due to the hot gas than it would be without the cooling.

A turbine airfoil is described in EP 1 327 747 A2, wherein cooling air is flowed inside the airfoil.

SUMMARY OF INVENTION

It is an object of the invention to obtain a cooled turbine blading for a turbomachine, wherein the turbine blading has a high aerodynamic efficiency.

The inventive turbine airfoil, particularly a blade or a vane for a turbomachine, comprises a suction side wall and a pressure side wall bordering an airfoil cavity, which is adapted to be flowed through by a cooling fluid for cooling of the side walls and therefore of the turbine airfoil, wherein the suction side wall comprises at least one protrusion extending therefrom inside the cavity, characterized in that the number of the at least one protrusion on the suction side wall is higher than the number of protrusions on the pressure side wall, the density of the at least one protrusion on the suction side wall is higher than the density of protrusions on the pressure side wall and/or the surface of the at least one protrusion on the suction side wall is larger than the surface of protrusions on the pressure side wall, so that the heat transfer from the suction side wall to the cooling fluid is higher compared to the heat transfer from the pressure side wall to the cooling fluid during the operation of the turbomachine such that an excess of the heat transfer from the suction side wall is generated.

The airfoil may particularly be a film cooled airfoil. For all or parts of an exterior surface of the airfoil film cooling is provided via film cooling holes in the side walls of the airfoil.

The inventive turbine airfoil or turbine blading can be a rotating blade or a stationary guide vane. The inventive turbine blading comprises one protrusion or a plurality of protrusions. During operation of the turbomachine, the walls of the turbine blade or guide vane are heated up due to hot gas flowing along the external walls. Heat is transported by heat conduction to the protrusion of the suction side wall. The protrusion has the effect of increasing the inner surface of the suction side wall, whereby convective cooling by the cooling fluid flowing through the cavity is increased. The cooling may particularly be film cooling and/or convective cooling. The overall cooling of the suction side wall comprises a contribution from the convective cooling from inside the turbine airfoil and may have an additional contribution from the film cooling from outside the blade or guide vane. Because of the increased heat transfer of the convective cooling, a reduced amount of the cooling fluid overall for the blading or specifically for the external film cooling can be used for the suction side wall. Along the suction side wall the velocity of hot gas during the operation of the turbomachine is higher compared to that of the pressure side wall. Therefore, mixing losses in areas with high velocity gradients between the hot gas and the cooling fluid are reduced and consequently the efficiency of the turbomachine is advantageously increased. The extension of the protrusion should be specified such that a compromise is found between the large inner surface for an effective cooling and a small blockage for the cooling fluid flow inside the cavity.

It is preferred that at least one of the protrusions is a turbulator for the cooling fluid flow. Downstream from the turbulator a turbulent boundary layer is developing, which advantageously cools the suction side wall efficiently by the convective cooling. At least one of the protrusions is preferably a cylinder, a cone, a pyramid or a tetrahedron. Alternatively, at least one of the protrusions is preferably an elongated rib, in particular with a triangular cross section. The elongated rib can advantageously increase the mechanical stability of the turbine blading. It is preferred that on the downstream side of the protrusion a flow separation, which would lead to a formation of a recirculation zone, is prevented. The cooling fluid can be trapped in the recirculation zone, whereby the convective cooling would be affected. With the preferred shapes of the protrusion a large surface inside the turbine airfoil with a small blockage for the cooling fluid flow can advantageously be achieved.

It is preferred that at least one of the protrusions extends from the suction side wall to the pressure side wall. The turbine airfoil has consequently a high mechanical stability. In order to obtain the higher heat transfer from the suction side wall to the cooling fluid compared to that of the pressure side wall, the thickness of the protrusion portion attached to the suction side wall is preferably larger than the thickness of the protrusion portion attached to the pressure side wall. At least one of the protrusions is preferably a truncated cone and/or a cylinder. Further, it is preferred that at least one of the protrusions is located adjacent to the trailing edge of the turbine blade or guide vane. Cooling is in particular important near the trailing edge and the protrusion adjacent to the trailing edge increases advantageously the convective cooling in this area. Further, it is preferred that the turbine blade or vane comprises at least one passage in the trailing edge connecting the cavity with the outside of the blade or vane, wherein the passage is provided for the outflow of the cooling fluid from the cavity. Therefore, the flow of the cooling fluid around the protrusion adjacent to the trailing edge is high and the convective cooling of this protrusion is advantageously high.

In an embodiment the suction side wall comprises a plurality of film cooling holes. Via the film cooling holes the cooling fluid is transported from the cavity to the surface of the blade or vane in order to form a cooling film on the turbine blade or vane surface, i.e. the outside surface of the airfoil along which the hot gas will pass during operation. Hence, the suction side wall can advantageously be cooled both from inside and outside of the blade or vane, i.e. the airfoil or the blading. The cooling film not only cools the airfoil by convection but it also functions as a barrier against the hot gas to prevent the hot gas from flowing at the turbine airfoil wall. The number of the film cooling holes on the suction side wall is smaller than the number of film cooling holes on the pressure side wall, the density of the film cooling holes on the suction side wall is smaller than the density of film cooling holes on the pressure side wall and/or the diameter of the film cooling holes on the suction side wall is smaller than the diameter of film cooling holes on the pressure side wall so that the excess of the heat transfer caused by the protrusions is compensated. Therefore, the amount of cooling fluid transported on the turbine airfoil surface of the suction side wall is minimised. Consequently, the mixing losses of the cooling fluid and the hot gas are advantageously lower while the heat transfer from the suction side wall to the cooling fluid is unchanged.

It is also possible that the turbine blade or vane comprises on its outer surface a thermal barrier coating, e.g. a ceramic coating, to increase the thermal resilience of the turbine blading and therefore increase the lifetime of the turbine blading.

BRIEF DESCRIPTION OF THE DRAWINGS

In the following the invention is explained on the basis of a preferred embodiment of the turbine blading with reference to the drawing. In the drawing the FIGURE shows a sectional view of the embodiment.

DETAILED DESCRIPTION OF INVENTION

In the FIGURE, an embodiment of a turbine airfoil 1 of a turbomachine is shown. The turbine airfoil 1 can be a rotor blade as well as a guide vane. The turbine airfoil 1 comprises a suction side wall 2 and a pressure side wall 3 which border a cavity 4—an airfoil cavity, a hollow space inside the airfoil 1—inside the turbine airfoil 1. In the FIGURE, the trailing edge 11 of the turbine airfoil 1 and the area adjacent to the trailing edge 11 are shown. The width of the cavity 4 reduces towards the trailing edge 11.

Each of the walls 2, 3 comprises an inner face 6 and an outer face 5. During the operation of the turbomachine a hot gas (not shown) flows in the flow channel 13 between two adjacent turbine airfoils along the walls 2, 3 with a main flow direction directed from the leading edge (not shown) to the trailing edge 11. In the cavity a cooling fluid 7 flows with a cooling fluid main flow direction 8 which is substantially parallel to the walls 2, 3 and oriented towards the trailing edge 11. At the trailing edge 11 the turbine airfoil 1 comprises a passage 12 via which the cooling fluid 7 discharges the cavity 4. At the trailing edge 11, the suction side wall 2 is more elongated than the pressure side wall 3, so that after discharging the cavity 4 the cooling fluid 7 flows along the inner face 6 of the suction side wall, providing a flow or film of cooling fluid. It is also possible that the suction side wall 2 and the pressure side wall 3 are the same length.

The suction side wall 2 comprises two protrusions 9 extending therefrom inside the cavity 4. Possible is also that the suction side wall 2 comprises one protrusion 9 or a plurality of protrusions 9. The protrusions 9 have a conical shape with the base of the cone arranged on the inner face 6 of the suction side wall 2. With the protrusions 9 a large surface inside the turbine airfoil 1 with a small blockage for the cooling fluid 7 flow can be achieved. The shape of the cone is preferably such that the edge of the cone has such a large angle that a flow separation downstream of the cone, which would result in the formation of a recirculation zone, is avoided. Other shapes of the protrusions 9 are also possible, for example a truncated cone, with the larger base arranged on the suction side wall, a shape that would particularly prevent the flow separation.

Also possible is that the protrusions 9 have such a shape that they function as turbulators. The turbulators have the effect that downstream of the cooling fluid 7 main flow direction 8, the cooling fluid 7 flow originating from the turbulators has increased turbulence. A cooling fluid 7 flow with enhanced turbulence cools the suction side wall 2 more efficiently by convective cooling than a cooling flow 7 along a smooth surface which may substantially form a film on the surface.

Also shown in the FIGURE is a pedestal 10 with a cylindrical shape, which is arranged between both protrusions 9 and extends from the suction side wall 2 to the pressure side wall 3. The pedestal can also have an e.g. rectangular cross section. In another preferred embodiment, in order to have a higher heat transfer from the suction side wall 2 the pedestal 10 can be a truncated cone, with the larger base of the truncated cone arranged on the suction side wall 2 and the smaller base arranged on the pressure side wall 3. In a further preferred embodiment the pedestal 10 comprises a truncated cone, which is arranged with its larger base at the suction side wall 2 and at its smaller base a cylinder is arranged, which extends to the pressure side wall 3. The diameter of the pedestal 10 is chosen such that sufficient cooling fluid 7 for the convective cooling can be flown around the pedestal. It is preferred that the protrusions 9 and the pedestal 10 are arranged at gap, so that they are not in the flow shadow zone of each other. It is also preferred that the protrusions 9 and the pedestals 10 are arranged in a distance from the tip or hub, leading edge and trailing edge 11 of the airfoil 1, so that sufficient cooling air 7 can be provided for these areas.

Possible is also a preferred embodiment, wherein the turbine airfoil 1 comprises a plurality of film cooling holes 14 in the walls 2, 3. Due to the protrusions 9 on the suction side wall 2 the distance between film cooling holes can be increased and the total flow of air reduced, compared to an airfoil 1 with the protrusions 9, whereby the contribution of the film cooling is smaller on the suction side wall 2. Hence, losses due to mixing of the hot gas and the cooling fluid 7 on the suction side wall 2 are reduced. Also possible is that sufficient cooling from inside the airfoil 1 is achieved due to the protrusions so that the film cooling can be completely eliminated.

Although the invention is described in detail by the preferred embodiments, the invention is not constrained by the disclosed examples and other variations can be derived by the person skilled in the art, without leaving the extent of the protection of the invention.

What is claimed is:

1. A turbine airfoil for a turbomachine, the turbine airfoil comprising:

a suction side wall and a pressure side wall bordering an airfoil cavity, which is adapted to be flowed through by a cooling fluid for cooling of the side walls, wherein the suction side wall comprises protrusions extending therefrom inside the airfoil cavity, wherein the protrusions are arranged such that:

a number of the protrusions on the suction side wall is higher than a number of protrusions on the pressure side wall; and/or a protrusion density on the suction side wall is higher than a protrusion density on the pressure side wall, and/or a total protrusion surface area on the suction side wall is larger than a total protrusion surface area on the pressure side wall, so that the heat transfer from the suction side wall to the cooling fluid is higher compared to the heat transfer from the pressure side wall to the cooling fluid during operation of the turbomachine, and wherein the suction side wall and the pressure side wall each comprise film cooling holes and a respective diameter of the film cooling holes on the suction side wall is smaller than a respective diameter of the film cooling holes on the pressure side wall.

2. The turbine airfoil according to claim 1, wherein at least one of the protrusions extending from the suction side wall is a turbulator for the cooling fluid flow.

3. The turbine airfoil according to claim 1, wherein at least one of the protrusions extending from the suction side wall is a cone, a pyramid or a tetrahedron.

4. The turbine airfoil according to claim 1, wherein at least one of the protrusions extending from the suction side wall is an elongated rib.

5. The turbine airfoil according to claim 1, wherein at least one of the protrusions extending from the suction side wall extends from an interior surface of the suction side wall to the pressure side wall forming a pedestal around which the cooling fluid can flow.

6. The turbine airfoil according to claim 1, wherein at least one of the one or more protrusions is located adjacent to a trailing edge of the turbine airfoil.

7. The turbine airfoil according to claim 1, wherein the turbine airfoil comprises a trailing edge and at least one passage in the trailing edge, wherein the at least one passage is provided for outflow of the cooling fluid from the airfoil cavity.

8. The turbine airfoil according to claim 1, wherein the turbine airfoil is film cooled.

9. The turbine airfoil according to claim 1, wherein the film cooling holes are arranged such that:

a number of the film cooling holes on the suction side wall is smaller than a number of film cooling holes on the pressure side wall, and/or a density of the film cooling holes on the suction side wall is smaller than a density of film cooling holes on the pressure side wall.

10. The turbine airfoil according to claim 1, wherein at least one of the protrusions extending from the suction side wall is an elongated rib with a triangular cross section.

11. The turbine airfoil according to claim 1, wherein the turbine airfoil comprises a trailing edge, and wherein at the trailing edge the suction side wall extends aft farther than the pressure side wall.

12. The turbine airfoil according to claim 1, wherein the turbine airfoil comprises a trailing edge and a leading edge, wherein the airfoil cavity is disposed immediately upstream of an exit passage through the trailing edge, and wherein a direction of flow of the cooling fluid through the airfoil cavity and out the exit passage is from the leading edge toward the trailing edge.

13. A turbine airfoil for a turbomachine, the turbine airfoil comprising:

a leading edge, a trailing edge, and a suction side wall and a pressure side wall that define an airfoil cavity immediately upstream of an exit passage through the trailing edge, the turbine airfoil configured to pass a flow of cooling fluid through the airfoil cavity in a direction from the leading edge toward the trailing edge, wherein the suction side wall comprises suction-side protrusions extending therefrom into the flow of cooling fluid, wherein the pressure side wall comprises one or more pressure-side protrusions extending therefrom into the flow of cooling fluid, and wherein a protrusion density of the suction-side protrusions is higher than a protrusion density of the one or more pressure-side protrusions so that the heat transfer from the suction side wall to the flow of cooling fluid is higher compared to the heat transfer from the pressure side wall to the flow of cooling fluid during operation of the turbomachine, and suction side film cooling holes through the suction side wall and pressure side film cooling holes through the pressure side wall, wherein a respective diameter of the suction side film cooling holes is smaller than a respective diameter of the pressure side film cooling holes.

14. The turbine airfoil according to claim 13, wherein a number, a density, and the diameter, respectively, of the suction side film cooling holes is smaller than that of a number, a density, and the diameter, respectively, of the pressure side film cooling holes.

15. A turbine airfoil for a turbomachine, the turbine airfoil comprising:

a leading edge, a trailing edge, and a suction side wall and a pressure side wall that define an airfoil cavity immediately upstream of an exit passage through the trailing edge, the turbine airfoil configured to pass a flow of cooling fluid through the airfoil cavity in a direction from the leading edge toward the trailing edge, wherein the suction side wall comprises protrusions extending therefrom into the flow of cooling fluid, wherein the pressure side wall comprises one or more protrusions extending therefrom into the flow of cooling fluid, wherein the protrusions are arranged such that:

a number of the protrusions on the suction side wall is higher than a number of the one or more protrusions on the pressure side wall; and a protrusion density of the protrusions on the suction side wall is higher than a protrusion density of the one or more protrusions on the pressure side wall, and a total protrusion surface area of the protrusions on the suction side wall is larger than a total protrusion surface area of the one or more protrusions on the pressure side wall, so that the heat transfer from the suction side wall to the flow of cooling fluid is higher compared to the heat transfer from the pressure side wall to the flow of cooling fluid during operation of the turbomachine, the turbine airfoil further comprising film cooling holes arranged such that:

a number of the film cooling holes on the suction side wall is smaller than a number of film cooling holes on the pressure side wall, and a density of the film cooling holes on the suction side wall is smaller than a density of film cooling holes on the pressure side wall, and a diameter of the film cooling holes on the suction side wall is smaller than a diameter of film cooling holes on the pressure side wall.

* * * * *